US008444437B2

(12) United States Patent
Szczesny et al.

(10) Patent No.: US 8,444,437 B2
(45) Date of Patent: May 21, 2013

(54) ELECTRICAL CONNECTOR ASSEMBLY WITH EMI GASKET

(75) Inventors: David Szczesny, Hershey, PA (US); Michael Eugene Shirk, Grantvill, PA (US); Michael J. Phillips, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/197,413

(22) Filed: Aug. 3, 2011

(65) Prior Publication Data

US 2013/0034993 A1 Feb. 7, 2013

(51) Int. Cl.
*H01R 13/648* (2006.01)

(52) U.S. Cl.
USPC ..... 439/607.17; 361/704

(58) Field of Classification Search
USPC ..... 165/80.2, 80.3, 185; 361/704, 715, 361/716, 719; 385/92–94; 439/76.1, 607.17, 439/924.1
See application file for complete search history.

(56) References Cited

U.S. PATENT DOCUMENTS

| | | | | |
|---|---|---|---|---|
| 6,816,376 | B2 * | 11/2004 | Bright et al. | 361/704 |
| 6,980,437 | B2 * | 12/2005 | Bright | 361/704 |
| 7,001,217 | B2 | 2/2006 | Bright et al. | |
| 7,077,696 | B2 * | 7/2006 | Haga et al. | 439/553 |
| 7,219,404 | B2 * | 5/2007 | Haga et al. | 24/458 |
| 7,371,965 | B2 * | 5/2008 | Ice | 174/50 |
| 7,438,596 | B2 | 10/2008 | Phillips | |
| 7,457,126 | B2 * | 11/2008 | Ahrens | 361/716 |
| 7,529,094 | B2 * | 5/2009 | Miller | 361/715 |
| 7,539,018 | B2 | 5/2009 | Murr et al. | |
| 7,625,223 | B1 | 12/2009 | Fogg | |

* cited by examiner

*Primary Examiner* — Thanh Tam Le

(57) ABSTRACT

An electrical connector assembly includes a cage having a front end and an internal compartment. The front end is open to the internal compartment of the cage. The internal compartment is configured to receive a pluggable module therein through the front end. An electromagnetic interference (EMI) gasket is mounted to the front end of the cage such that the EMI gasket is engaged with an electrically connected to the cage. The EMI gasket includes electrically conductive springs that are configured to engage and electrically connect to the pluggable module when the pluggable module is received within the internal compartment of the cage. The EMI gasket including a flange. A bracket is mounted to the front end of the cage such that the bracket extends at least partially around the EMI gasket. The bracket having a wall that is engaged with the flange of the EMI gasket for holding the EMI gasket on the front end of the cage.

20 Claims, 7 Drawing Sheets

ELECTRICAL CONNECTOR ASSEMBLY WITH EMI GASKET

BACKGROUND OF THE INVENTION

The subject matter described and/or illustrated herein relates generally to electrical connector assemblies, and more particularly to electromagnetic interference (EMI) gaskets for electrical connector assemblies.

Various types of fiber optic and copper based transceiver assemblies that permit communication between host equipment and external devices are known. These transceiver assemblies typically include a pluggable module that is received within a receptacle assembly, which includes a receptacle connector that pluggable connects to the pluggable module. The pluggable modules are constructed according to various standards for size and compatibility, one standard being the Quad Small Form-factor Pluggable (QSFP) module standard. Conventional QSFP modules and receptacle assemblies perform satisfactorily conveying data signals at rates up to 10 gigabits per second (Gbps). Another pluggable module standard, the XFP standard, calls for the transceiver module to also convey data signals at rates up to 10 Gbps.

Receptacle assemblies typically include a metal cage having a port that receives the pluggable module therein. The receptacle connector is held in the cage for connection with the pluggable module as the module is inserted into the cage. An end of the cage that includes the port typically includes a plurality of springs that extend circumferentially about an interior surface of the cage. The springs engage the pluggable module when the module is installed in the cage to facilitate containing electromagnetic interference (EMI) emissions by providing a plurality of contact points that ground the pluggable module to the cage. The springs are sometimes fabricated from a different material than the cage and thereafter mechanically attached thereto. Known methods for attaching the springs to the cage include soldering or welding the springs to the cage. But, soldering or welding the springs to the cage may be less reliable and/or may present quality control issues. Moreover, soldering or welding the springs to the cage may increase a cost of fabricating the cage.

BRIEF DESCRIPTION OF THE INVENTION

In one embodiment, an electrical connector assembly includes a cage having a front end and an internal compartment. The front end is open to the internal compartment of the cage. The internal compartment is configured to receive a pluggable module therein through the front end. An electromagnetic interference (EMI) gasket is mounted to the front end of the cage such that the EMI gasket is engaged with an electrically connected to the cage. The EMI gasket includes electrically conductive springs that are configured to engage and electrically connect to the pluggable module when the pluggable module is received within the internal compartment of the cage. The EMI gasket including a flange. A bracket is mounted to the front end of the cage such that the bracket extends at least partially around the EMI gasket. The bracket having a wall that is engaged with the flange of the EMI gasket for holding the EMI gasket on the front end of the cage.

In another embodiment, an electrical connector assembly includes a cage having a front end and an internal compartment. The front end is open to the internal compartment of the cage. The internal compartment is configured to receive a pluggable module therein through the front end. An electromagnetic interference (EMI) gasket includes a base and electrically conductive springs that extend from the base. The base is mounted to the front end of the cage such that the base is engaged with and electrically connected to the cage and such that the springs extend within the internal compartment of the cage. The springs are configured to engage and electrically connect to the pluggable module when the pluggable module is received within the internal compartment of the cage. The EMI gasket includes a flange. A bracket is mounted to the front end of the cage such that the bracket extends at least partially around the EMI gasket. The bracket has a wall that is engaged with the flange of the EMI gasket for holding the EMI gasket on the front end of the cage.

In another embodiment, a transceiver assembly includes a pluggable module, and a receptacle assembly. The receptacle assembly includes a cage and a receptacle connector received within the cage. The cage has a front end and an internal compartment. The front end is open to the internal compartment of the cage. The receptacle connector is positioned within the internal compartment of the cage at a rear end of the cage. The internal compartment is configured to receive the pluggable module therein in electrical connection with the receptacle connector. The receptacle assembly further includes an electromagnetic interference (EMI) gasket and a bracket. The EMI gasket is mounted to the front end of the cage such that the EMI gasket is engaged with an electrically connected to the cage. The EMI gasket includes electrically conductive springs that are configured to engage and electrically connect to the pluggable module when the pluggable module is received within the internal compartment of the cage. The EMI gasket includes flange. The bracket is mounted to the front end of the cage such that the bracket extends at least partially around the EMI gasket. The bracket includes a wall that is engaged with the EMI gasket for holding the EMI gasket on the front end of the cage.

DETAILED DESCRIPTION OF THE INVENTION

Figure 1:
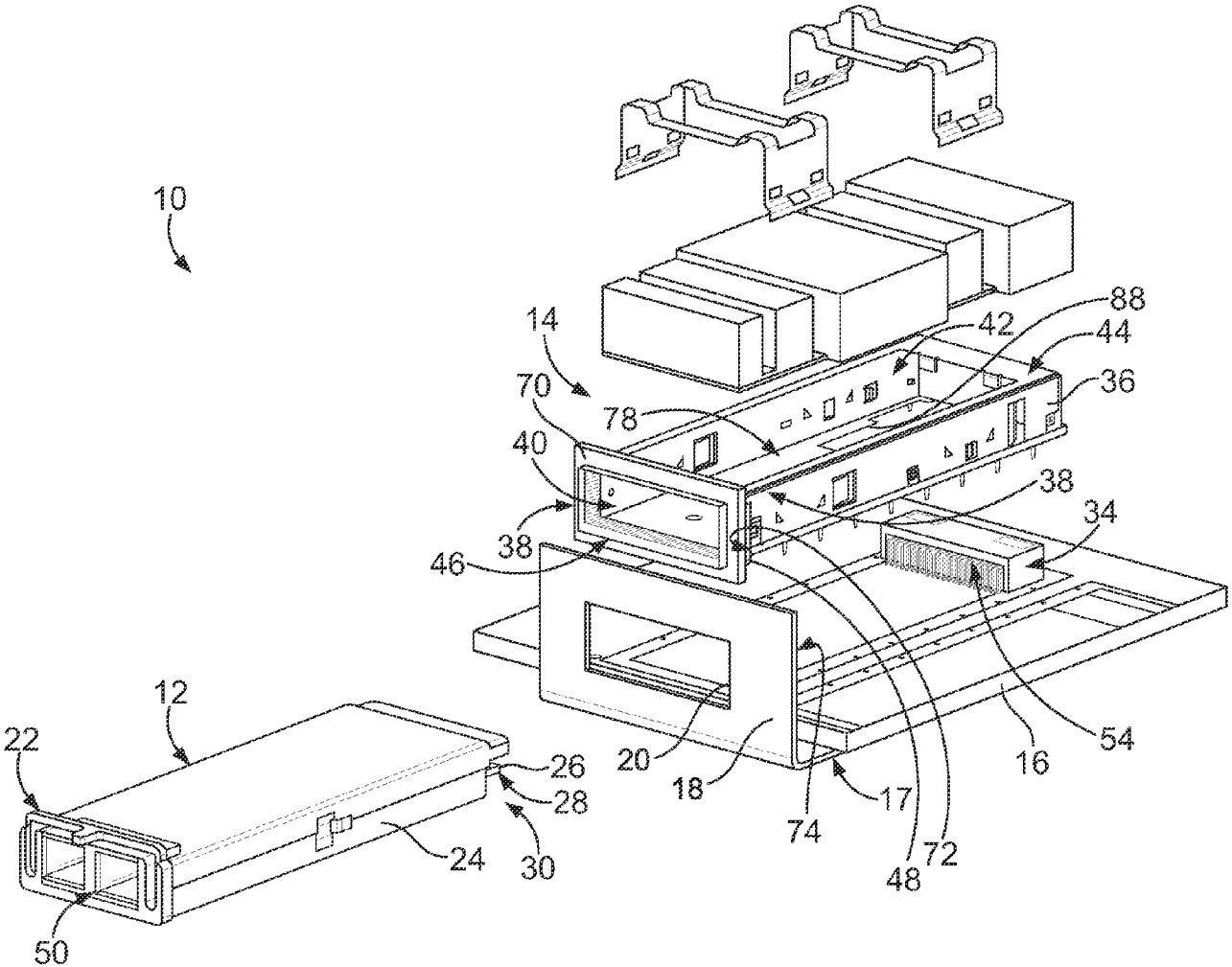
FIG. 1 is an exploded perspective view of an exemplary embodiment of a transceiver assembly.

FIG. 1 is a perspective view of a portion of an exemplary embodiment of a transceiver assembly 10. In the exemplary embodiment, the transceiver assembly 10 is adapted to address, among other things, conveying data signals at high rates, such as data transmission rates of at least 10 gigabits per second (Gbps), which is required by the SFP+ standard. For example, in some embodiments the transceiver assembly 10 is adapted to convey data signals at a data transmission rate of at least 28 Gbps. Moreover, and for example, in some embodiments the transceiver assembly 10 is adapted to convey data signals at a data transmission rate of between approximately 20 Gbps and approximately 30 Gbps. It is appreciated, however, that the benefits and advantages of the subject matter described and/or illustrated herein may accrue equally to other data transmission rates and across a variety of systems and standards. In other words, the subject matter described and/or illustrated herein is not limited to data transmission rates of 10 Gbps or greater, any standard, or the exemplary type of transceiver assembly shown and described herein.

The transceiver assembly 10 includes a pluggable module 12 configured for pluggable insertion into a receptacle assembly 14 that is mounted on a host circuit board 16. The host circuit board 16 may be mounted in a host system (not shown) such as, but not limited to, a router, a server, a computer, and/or the like. The host system typically includes a conductive chassis 17 having a panel 18 including an opening 20 extending therethrough in substantial alignment with the receptacle assembly 14. The receptacle assembly 14 is optionally electrically connected to the panel 18.

The pluggable module 12 is configured to be inserted into the receptacle assembly 14. Specifically, the pluggable module 12 is inserted into the receptacle assembly 14 through the panel opening 20 such that a front end 22 of the pluggable module 12 extends outwardly from the receptacle assembly 14. The pluggable module 12 includes a housing 24 that forms a protective shell for a circuit board 26 that is disposed within the housing 24. The circuit board 26 carries circuitry, traces, paths, devices, and/or the like that perform transceiver functions in a known manner. An edge 28 of the circuit board 26 is exposed at a rear end 30 of the housing 24. In an exemplary embodiment, a straddle mount connector 32 (FIG. 2) is mounted to the circuit board 26 and exposed through the rear end 30 of the housing 24 for plugging into a receptacle connector 34 of the receptacle assembly 14. The connector 32 is not shown in FIG. 1. In alternative to the connector 32, the circuit board 26 of the pluggable module 12 may directly mate with the receptacle connector 34. In other words, in some alternative embodiments, the edge 28 of the circuit board 26 of the pluggable module 12 is received within a receptacle 54 of the receptacle connector 34 to electrically connect the pluggable module 12 to the receptacle connector 34.

In general, the pluggable module 12 and the receptacle assembly 14 may be used in any application requiring an interface between a host system and electrical and/or optical signals. The pluggable module 12 interfaces to the host system through the receptacle assembly 14 via the receptacle connector 34 of the receptacle assembly 14, which is located within an electrically conductive cage 36 (which is sometimes referred to as a "receptacle guide frame" or a "guide frame"). As illustrated in FIG. 1, the cage 36 includes a front end 38 having a front opening, or port, 40 that is open to an internal compartment 42 of the cage 36. The receptacle connector 34 is positioned within the internal compartment 42 at a rear end 44 of the cage 36. The cage 36 includes an opening 88 extending through a lower wall 78 of the cage 36 for enabling the receptacle connector 34 to electrically connect to the host circuit board 16 (FIGS. 1 and 2) from within the internal compartment 42. The internal compartment 42 of the cage 36 is configured to receive the pluggable module 12 therein in electrical connection with the receptacle connector 34. The cage 36 optionally includes one or more over-travel stops 102 that facilitate limiting the amount of travel of the pluggable module 12 along the length of the cage 36, such that the pluggable module 12 is not over inserted into the internal compartment 42 of the cage 36.

The front end 38 of the cage 36 is configured to be mounted, or received, within the opening 20 in the panel 18. An EMI gasket 46 is mounted to the front end 38 of the cage 36. The EMI gasket 46 facilitates reducing and/or containing electromagnetic interference (EMI) emissions. As will be described in more detail below, a bracket 48 optionally engages the EMI gasket 46 for holding the EMI gasket 46 on the front end 38 of the cage 36. A combination of the cage 36 and the EMI gasket 46 may be referred to herein as an "electrical connector assembly". A combination of the cage 36, the EMI gasket 46, and the bracket 48 may be referred to herein as an "electrical connector assembly".

The pluggable module 12 interfaces to one or more optical cables (not shown) and/or one or more electrical cables (not shown) through a connector interface 50 at the front end 22 of the module 12. Optionally, the connector interface 50 comprises a mechanism that cooperates with a fiber or cable assembly (not shown) to secure the fiber or cable assembly to the pluggable module 12. Suitable connector interfaces 50 are known and include adapters for the LC style fiber connectors and the MTP/MPO style fiber connectors offered by Tyco Electronics Corporation (Harrisburg, Pa.).

Figure 2:
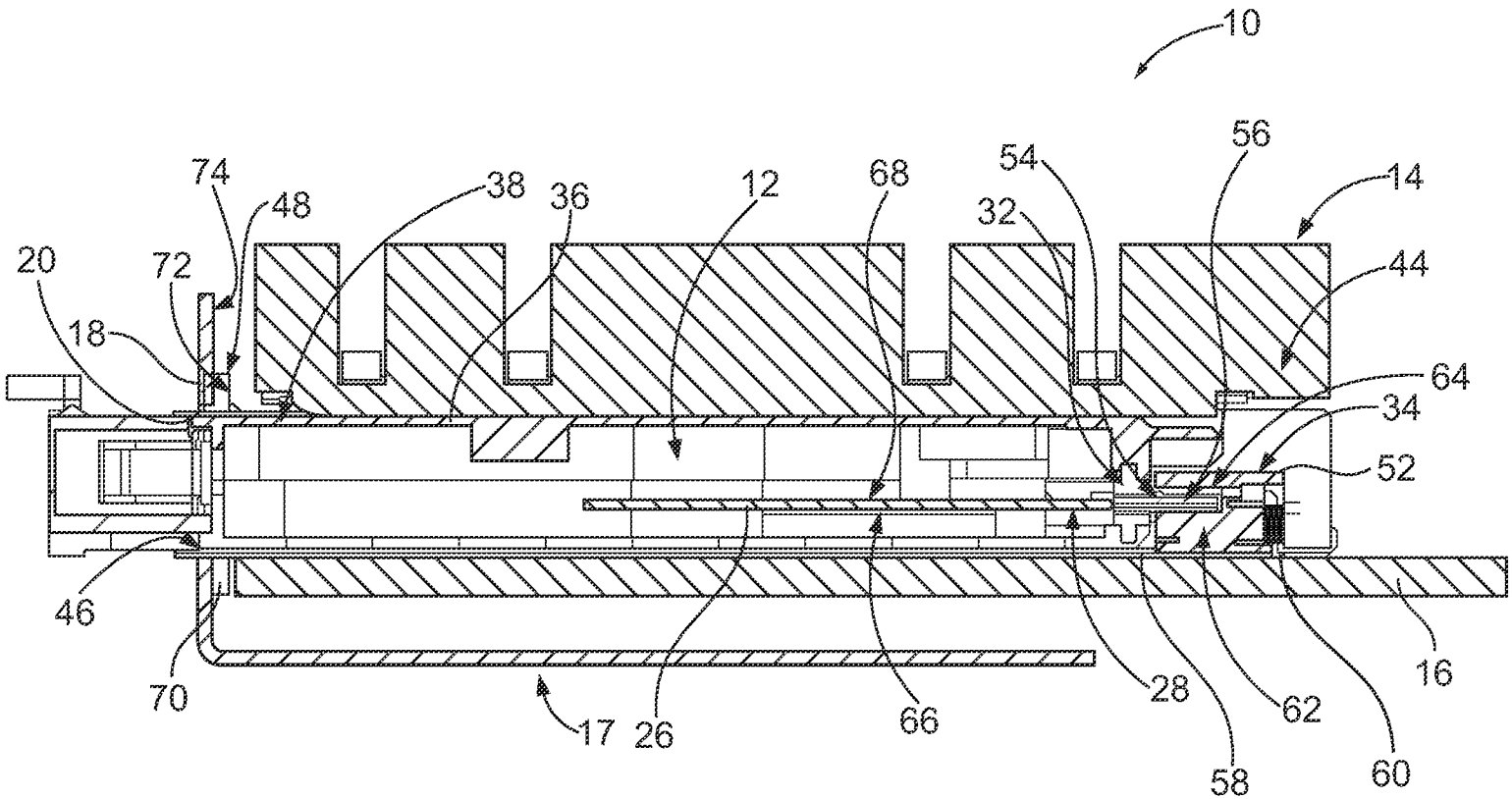
FIG. 2 is a cross-sectional view of the transceiver assembly shown in FIG. 1 illustrating an exemplary embodiment of a pluggable module mated with an exemplary embodiment of a receptacle assembly.

FIG. 2 is a cross-sectional view of the transceiver assembly 10 illustrating the pluggable module 12 mated with the receptacle assembly 14. The receptacle connector 34 is mounted on the host circuit board 16. The receptacle connector 34 includes a dielectric connector body 52 having the receptacle 54. Optionally, the straddle mount connector 32 is mounted to the edge 28 of the circuit board 26 in electrically connection therewith.

The receptacle 54 of the receptacle connector 34 receives a plug 56 of the straddle mount connector 32 therein. The receptacle connector 34 includes electrical contacts 58 and electrical contacts 60. The electrical contacts 58 extend within the receptacle 54 and engage corresponding electrical contacts (not shown) on a side 62 of the plug 56 of the straddle mount connector 32. The electrical contacts 60 also extend within the receptacle 54, but the electrical contacts 60 engage corresponding electrical contacts (not shown) on a side 64 of the plug 56 that is opposite the side 62. The electrical contacts of the straddle mount connector 32 are electrically connected to corresponding electrically conductive contact pads (not shown) on opposite sides 66 and 68 of the circuit board 26 to establish an electrical connection between the circuit board 26 and the host circuit board 16.

Referring now to FIGS. 1 and 2, the receptacle assembly 14 further includes the bracket 48 and a compressive gasket 70. The bracket 48 is best seen in FIG. 2. The compressive gasket 70 extends around the front end 38 of the cage 36 to facilitate reducing and/or containing EMI emissions. When the front end 38 of the cage 36 is mounted within the panel opening 20, the compressive gasket 70 is sandwiched between the bracket 48 and the panel 18. The compressive gasket 70 is configured to be at least partially compressed between the bracket 48 and the panel 18. More specifically, opposing sides 72 and 74 of the bracket 48 and the panel 18, respectively, engage the compressive gasket 70 such that the gasket 70 is at least partially compressed therebetween.

Figure 3:
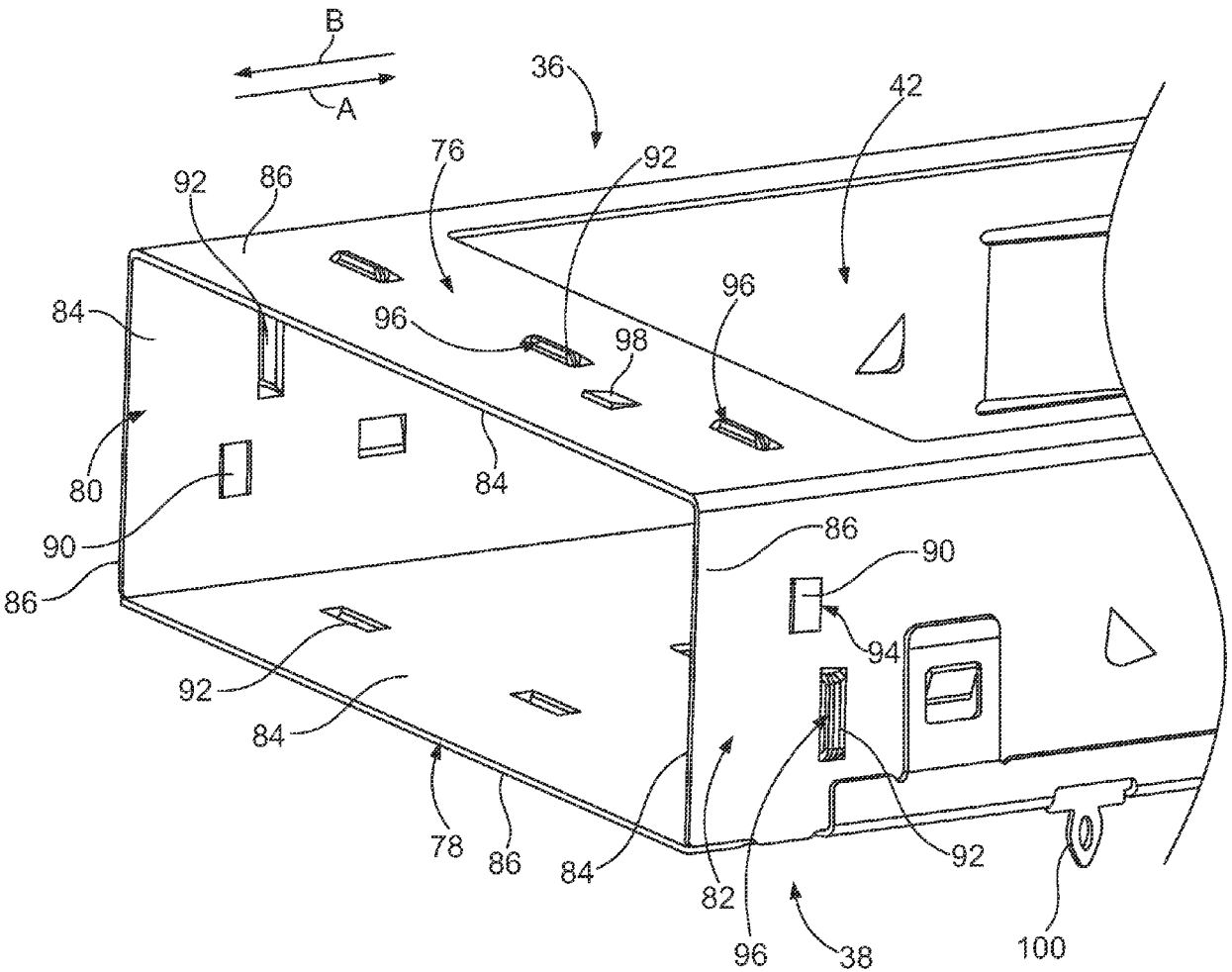
FIG. 3 is a perspective view of a portion of an exemplary embodiment of a cage of the transceiver assembly shown in FIGS. 1 and 2.

FIG. 3 is a perspective view of a portion of the cage 36. FIG. 3 illustrates the front end 38 of the cage 36. The cage 36 extends a length from the front end 38 to the rear end 44 (FIG. 1). The cage 36 includes an upper wall 76, a lower wall 78, and side walls 80 and 82. The walls 76, 78, 80, and 82 include interior surfaces 84 and exterior surfaces 86 that are opposite the interior surfaces 84. The internal compartment 42 of the cage 36 extends between the walls 76, 78, 80, and 82. More specifically, the interior surfaces 84 of the walls 76, 78, 80, and 82 define boundaries of the internal compartment 42.

The cage 36 includes one or more stops 90 and/or one or more stops 92 for holding the bracket 48 (FIGS. 1, 2, 6, and 7) on the front end 38 of the cage 36, as will be described in more detail below. Each stop 90 includes a rear side 94 that faces generally toward the rear end 44 of the cage 36. Each stop 92 includes a front side 96 that faces generally toward the front end 38 of the cage 36. More specifically, the rear side 94 faces generally in the direction of the arrow A in FIG. 3, while the front side 96 faces generally in the direction of the arrow B in FIG. 3.

Optionally, the cage 36 includes one or more orienting tabs 98 that cooperate with the EMI gasket 46, as will be described in more detail below. Although shown as being located on the upper wall 76 of the cage 36, each wall 78, 80, and/or 82 may additionally or alternatively include one or more orienting tabs 98. Each wall 76, 78, 80, and 82 may include any number of the orienting tabs 98. Moreover, the cage 36 may include any overall number of the orienting tabs 98.

In an exemplary embodiment, the cage 36 includes two stops 90 overall and eight stops 92 overall. But, the cage 36 may include any overall number of the stops 90 and any overall number of the stops 92. Moreover, in an exemplary embodiment, the side walls 80 and 82 each include one of the stops 90, and each of the walls 76, 78, 80, and 82 includes at least one stop 92. However, each wall 76, 78, 80, and 82 may include any number of the stops 90 and/or any number of the stops 92.

The cage 36 may have features that ground the cage 36 to the host circuit board 16, the panel 18, and/or the conductive chassis. For example, the cage 36 may include a plurality of circuit board tines 100, which may both mechanically hold and ground the cage 36 to the host circuit board 16. Additionally or alternatively, the cage 36 may include one or more resilient tongues (not shown) extending from the lower wall 78 to provide grounding of the cage 36 to the host circuit board 16.

Although the cage 36 is shown as including only one internal compartment 42 and only one port 40 for electrically connecting one pluggable module 12 to the host circuit board 16, the cage 36 may include any number of internal compartments 42 and ports 40, arranged in any pattern, configuration, arrangement, and/or the like (such as, but not limited to, any number of rows and/or columns), for electrically connecting any number of pluggable modules 12 to the host circuit board 16. In an exemplary embodiment, the cage 36 includes a generally rectangular cross-sectional shape, defined by the walls 76, 78, 80, and 82, such that the cage 36 generally has the shape of a parallelepiped. But, the cage 36 may include any other shape.

Figure 4:
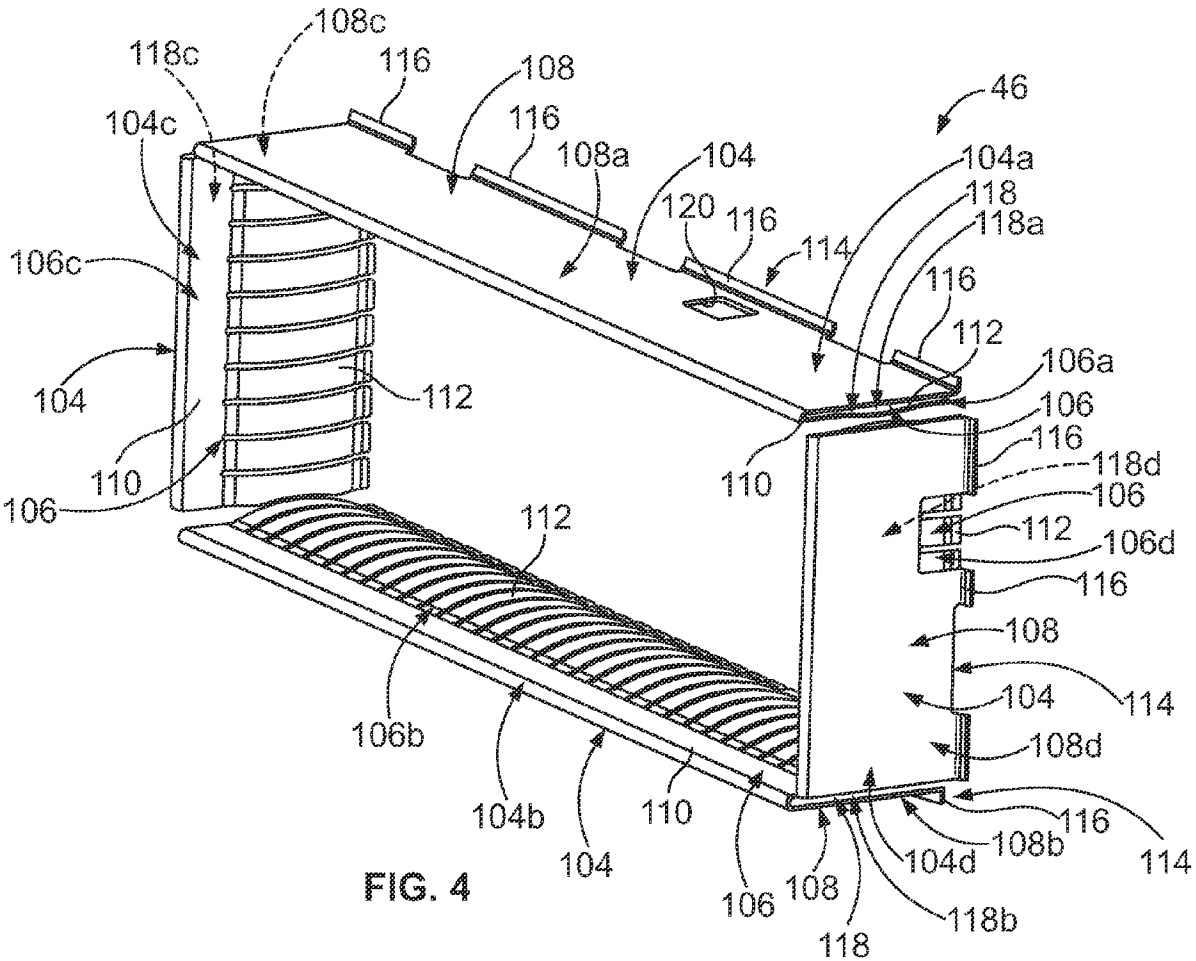
FIG. 4 is a perspective view of an exemplary embodiment of an EMI gasket of the transceiver assembly shown in FIGS. 1 and 2.

FIG. 4 is a perspective view of the EMI gasket 46. In an exemplary embodiment, the EMI gasket 46 includes four sections 104, namely sections 104*a*, 104*b*, 104*c*, and 104*d*. Each section 104*a*, 104*b*, 104*c*, and 104*d* is configured to be mounted to the front end 38 (FIGS. 1-3 and 5-7) of the cage 36 (FIGS. 1-3 and 5-7). More specifically, the sections 104*a*, 104*b*, 104*c*, and 104*d* are configured to be mounted to the walls 76, 78, 80, and 82 (FIGS. 3 and 5), respectively, at the front end 38 of the cage 36. When mounted to the cage 36, the sections 104*a*, 104*b*, 104*c*, and 104*d* of the EMI gasket 46 form an approximately parallelepiped shape to generally match the parallelepiped shape of the cage 36. However, the EMI gasket 46 may include any other shape, whether or not the shape of the EMI gasket 46 matches the shape of the cage 36. Moreover, the EMI gasket 46 may include any other number of sections 104 besides four, which optionally depends on the shape of the cage 36.

In an exemplary embodiment, the sections 104*a*, 104*b*, 104*c*, and 104*d* are separate and distinct from each other. As used herein, the term "separate and distinct" is intended to mean that the sections 104*a*, 104*b*, 104*c*, and 104*d* are not mechanically connected together before being mounted to the cage 36. However, when mounted on the cage 36, the separate and distinct sections 104*a*, 104*b*, 104*c*, and/or 104*d* may engage and/or be mechanically connected to adjacent sections 104. In some alternative embodiments, two or more of the sections 104*a*, 104*b*, 104*c*, and/or 104*d* are not separate and distinct from each other. In other words, in some alternative embodiments, two or more of the sections 104*a*, 104*b*, 104*c*, and/or 104*d* (e.g., adjacent sections) are mechanically connected together before being mounted to the cage 36. For example, in some alternative embodiments, all of the sections 104*a*, 104*b*, 104*c*, and 104*d* are mechanically connected to adjacent sections before being mounted to the cage 36 such that the sections 104*a*, 104*b*, 104*c*, and 104*d* form a continuous structure before being mounted to the cage 36. In other words, in some alternative embodiments, none of the sections 104*a*, 104*b*, 104*c*, and 104*d* are provided as separate and distinct from adjacent sections 104. When two adjacent sections 104 are not separate and distinct from each other, the sections 104 may be integrally formed, or may be separately formed and mechanically connected together before being mounted on the cage 36.

Each of the sections 104 includes an inner segment 106 and an outer segment 108 that extends from the inner segment 106. More specifically, the sections 104*a*, 104*b*, 104*c*, and 104*d* include respective inner segments 106*a*, 106*b*, 106*c*, and 106*d* and respective outer segments 108*a*, 108*b*, 108*c*, and 108*d*. As will be described below, when the EMI gasket 46 is mounted to the cage 36, the inner segment 106 extends within the internal compartment 42 (FIGS. 1-3 and 5) over at least a portion of the interior surface 84 (FIGS. 3 and 5) at the front end 38 of the cage 36. The outer segment 108 extends over at least a portion of the exterior surface 86 at the front end 38 of the cage 36 when the EMI gasket 46 is mounted to the cage 36.

Each inner segment 106 includes a base 110 and a plurality of individual electrically conductive springs 112 that extend outwardly from the base 110. The individual springs 112 may be integrally formed with the corresponding base 110, or may be fabricated separately from the corresponding base 110 and thereafter connected thereto using any suitable method, structure, means, and/or the like, such as, but not limited to, welding, soldering, adhesives, mechanical fasteners, and/or the like. Each of the springs 112 is configured to engage the housing 24 (FIG. 1) of the pluggable module 12 (FIGS. 1 and 2) to electrically connect the springs 112, and therefore the base 110 and the EMI gasket 46 overall, to the pluggable module 12. Each section 104 may include any number of the springs 112.

The outer segments 108 extend lengths outwardly from the corresponding inner segments 106 to ends 114. The EMI gasket 46 includes one or more flanges 116 on one or more of the outer segments 108. In an exemplary embodiment, each outer segment 108 includes a plurality of flanges 116 that extend outwardly from the end 114 of the outer segment 108. The flanges 116 on the outer segment 108*c* of the section 104*c* are not shown herein. As will be described in more detail below, the flanges 116 engage the bracket 48 (FIGS. 1, 2, 6, and 7) for holding the EMI gasket 46 on the front end 38 of the cage 36.

In an exemplary embodiment, each of the flanges 116 extends outwardly from the corresponding outer segment 108 at an angle of approximately 90° relative to the corresponding outer segment 108. But, each flange 116 may extend outwardly from the corresponding outer segment an any other angle that is non-parallel with respect to the outer segment 108. Moreover, the flanges 116 are not limited to extending from the end 114 of the corresponding outer segment 108. Rather, each flange 116 may have any other location along the length of the corresponding outer segment 108. Each outer segment 108 may include any number of the flanges 116. For example, in some alternative embodiments, one or more of the outer segments 108 does not include any flanges 116. The EMI gasket 46 may include any overall number of flanges 116.

A pocket 118 is defined between the inner segment 106 and the outer segment 108 of each section 104. More specifically, the EMI gasket 46 includes a pocket 118*a* defined between the inner and outer segments 106*a* and 108*a*, respectively, of the section 104*a*, and a pocket 118*b* defined between the inner and outer segments 106*b* and 108*b*, respectively, of the section 104*b*. A pocket 118*c* is defined between the inner and outer segments 106*c* and 108*c*, respectively, of the section 104*c*. The EMI gasket 46 also includes a pocket 118*d* defined between the inner and outer segments 106*d* and 108*d* of the section 104*d*. As will be described in more detail below, the pockets 118 are configured to receive the walls 76, 78, 80, and 82 (FIGS. 3 and 5) of the cage 36 therein at the front end 38 of the cage 36. In an exemplary embodiment, each of the pockets 118 is U-shaped. But, each of the pockets 118 may additionally or alternatively include any other shape.

Optionally, the EMI gasket 46 includes one or more orienting openings 120 that cooperate with the orienting tab(s) 98 (FIGS. 3 and 5) of the cage 36, as will be described in more detail below. Although shown as being located on the outer segment 108*a* of the section 104*a*, each section 104*b*, 104*c*, and/or 104*d* may additionally or alternatively include one or more orienting openings 120, which may be located on the inner segment 106 or the outer segment 108 thereof. In addition or alternatively to the orienting opening 120 shown within the outer segment 108*a* of the section 104*a*, the section 104*a* may include an orienting opening on the inner segment 106*a*. Each section 104 may include any number of the orienting openings 120. Moreover, the EMI gasket 46 may include any overall number of the orienting openings 120.

Optionally, the entire EMI gasket 46 or portions thereof are fabricated from one or more different materials than the cage 36. For example, in some embodiments, the springs 112 are fabricated from one or more different materials than the cage 36.

Figure 5:
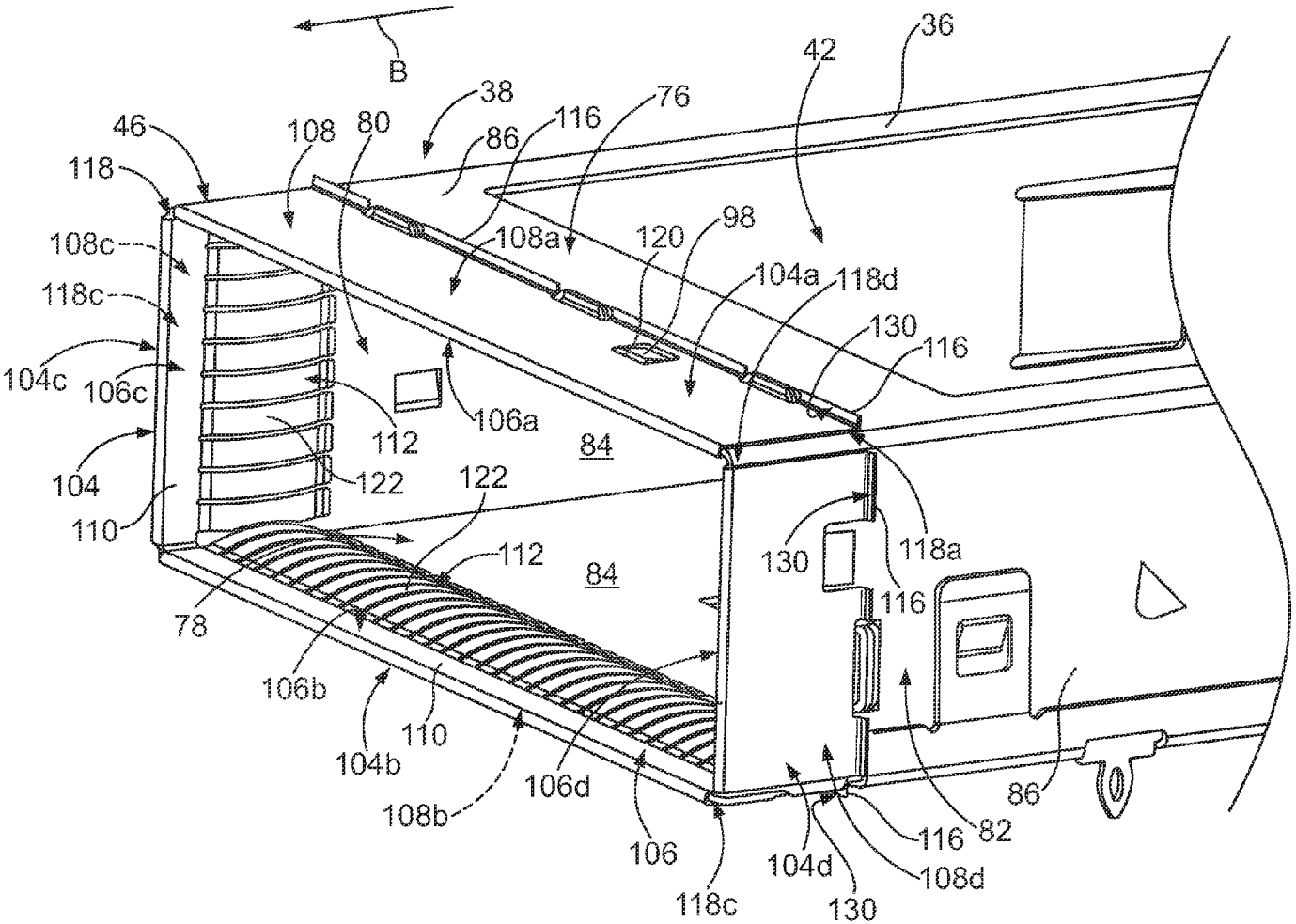
FIG. 5 is a perspective view illustrating the EMI gasket shown in FIG. 4 mounted to the cage shown in FIG. 3.

FIG. 5 is a perspective view illustrating the EMI gasket 46 mounted to the front end 38 of the cage 36. The inner segment 106 of each section 104 extends within the internal compartment 42 over at least a portion of the interior surface 84 at the front end 38 of the cage 36. More specifically, the inner segments 106*a*, 106*b*, 106*c*, and 106*d* extend within the internal compartment 42 over at least a portion of the interior surfaces 84 of the walls 76, 78, 80, and 82, respectively, at the front end 38 of the cage 36. The outer segment 108 of each section 104 extends over at least a portion of the exterior surface 86 at the front end 38 of the cage 36. More specifically, the outer segments 108*a*, 108*b*, 108*c*, and 108*d* extend over at least a portion of the exterior surfaces 86 of the respective walls 76, 78, 80, and 82 at the front end 38 of the cage 36. The flanges 116 of the outer segments 108 include front sides 130 that face generally toward the front end 38 of the cage 36, and more specifically in the direction of the arrow B in FIG. 5.

In an exemplary embodiment, the bases 110 of the inner segments 106*a*, 106*b*, 106*c*, and/or 106*d* are engaged with the interior surfaces 84 of the respective walls 76, 78, 80, and/or 82 such that the EMI gasket 46 is electrically connected to the cage 36. In addition or alternatively to the engagement of the inner segments 106*a*, 106*b*, 106*c*, and/or 106*d* with the interior surfaces 84, the outer segments 108*a*, 108*b*, 108*c*, and/or 108*d* may be engaged with the exterior surfaces 86 of the respective walls 76, 78, 80, and/or 82 to electrically connect the EMI gasket 46 to the cage 36. Moreover, in some embodiments, the springs 112 of the inner segments 106*a*, 106*b*, 106*c*, and/or 106*d* are configured to engage the interior surfaces 84 of the respective walls 76, 78, 80, and/or 82, for example after being engaged with the pluggable module 12 (FIGS. 1 and 2).

The springs 112 extend within the internal compartment 42 of the cage 36 such that the springs 112 are configured to engage the pluggable module 12. The springs 112 include interfaces 122 at which the springs 112 engage the housing 24 (FIG. 1) of the pluggable module 12 to electrically connect the EMI gasket 46 to the pluggable module 12. As can be seen in FIG. 5, the interfaces 122 extend within the internal compartment 42 of the cage 36 such that the interfaces 122 are configured to engage the housing 24 of the pluggable module 12 when the pluggable module 12 is received within the internal compartment 42 of the cage 36.

As can be seen in FIG. 5, when the EMI gasket 46 is mounted on the front end 38 of the cage 36, the front end 38 of the cage 36 is received within the pockets 118 of the EMI gasket 46. The walls 76, 78, 80, and 82 are received within the pockets 118*a*, 118*b*, 118*c*, and 118*d*, respectively, of the respective sections 104*a*, 104*b*, 104*c*, and 104*d* of the EMI gasket 46.

When the EMI gasket 46 is mounted on the cage 36, the orienting tab 98 of the cage 36 cooperates with the orienting opening 120 of the EMI gasket 46. Specifically, the orienting tab 98 is received within the orienting opening 120. Cooperation between the orienting tab 98 and the orienting opening 120 prevents the EMI gasket 46 from being mounted on the front end 38 of the cage 36 in an unintended orientation relative to the front end 38 of the cage 36. In other words, cooperation between the orienting tab 98 and the orienting opening 120 facilitates ensuring that the EMI gasket 46 is mounted on the front end 38 of the cage 36 in the intended orientation relative to the front end 38 of the cage 36. In an exemplary embodiment, the orienting tab 98 is received within the orienting opening 120 in a snap-fit type connection, but other types of connections may additionally or alternatively be provided between the orienting tab 98 and the orienting opening 120. Moreover, in addition or alternatively to the exemplary arrangement, the cage 36 may include one or more orienting openings (not shown) that cooperate with one or more orienting tabs (not shown) of the EMI gasket 46.

Figure 6:
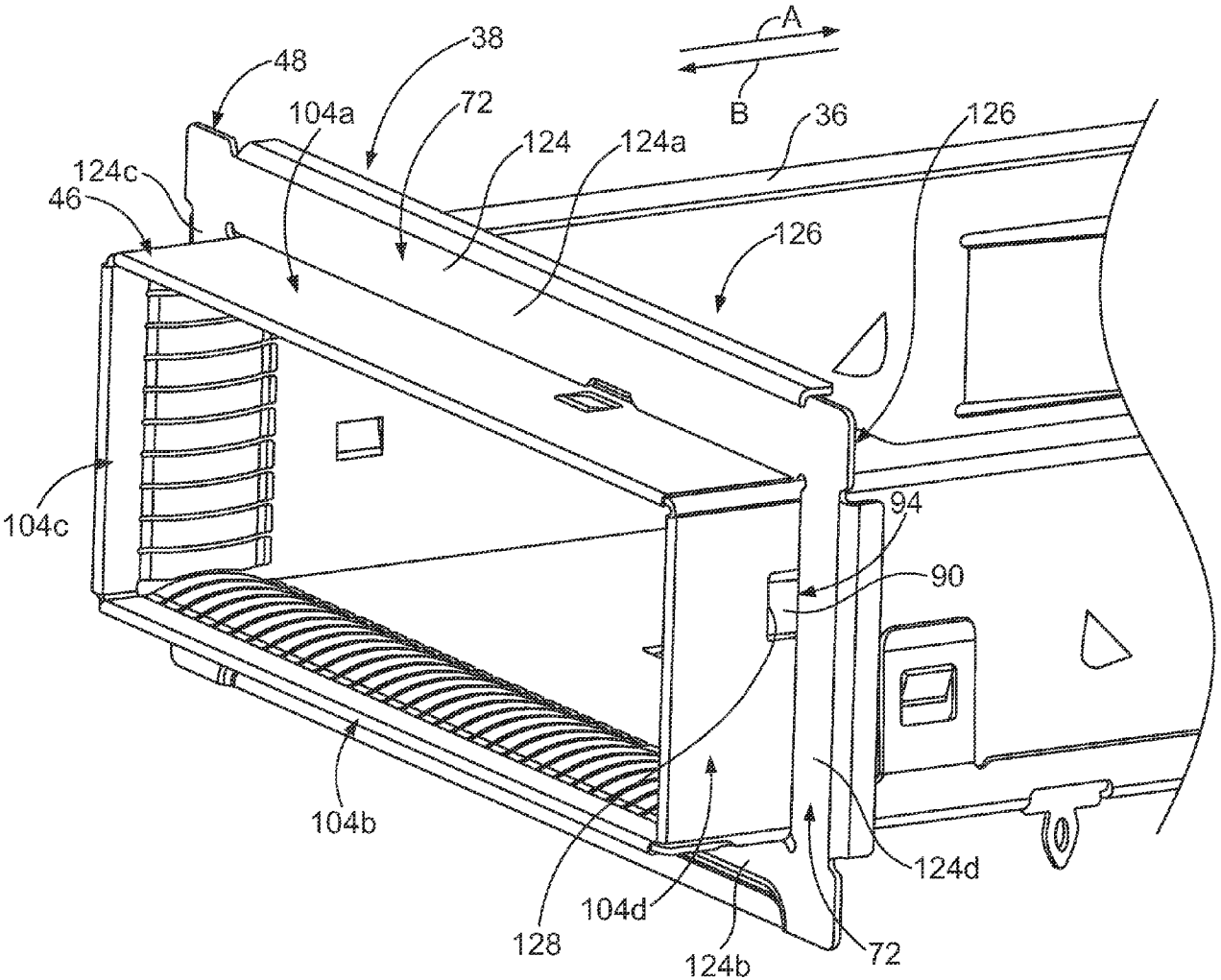
FIG. 6 is a perspective view illustrating an exemplary embodiment of a bracket mounted on the cage shown in FIGS. 3 and 5.

FIG. 6 is a perspective view illustrating the bracket 48 mounted to the cage 36. The bracket 48 is mounted to the front end 38 of the cage 36 such that the bracket 48 extends at least partially around the EMI gasket 46. The bracket 48 includes a plurality of walls 124. In an exemplary embodiment, the bracket 48 includes four walls 124*a*, 124*b*, 124*c*, and 124*d*. As can be seen in FIG. 6, the walls 124*a*, 124*b*, 124*c*, and 124*d* of the bracket 48 extend over the sections 104*a*, 104*b*, 104*c*, and 104*d*, respectively, of the EMI gasket 46. The walls 124 of the bracket 48 include the front side 72. The walls 124 of the bracket 48 also include an opposite rear side 126. The front side 72 faces generally toward the front end 38 of the cage 36, and more specifically in the direction of the arrow B in FIG. 6. The rear side 126 faces generally toward the rear end 44 (FIGS. 1 and 2) of the cage 36, and more specifically in the direction of the arrow A in FIG. 6.

The stops 90 of the cage 36 engage the bracket 48 to hold the bracket 48 on the front end 38 of the cage 36. The rear side 94 of each stop 90 engages the front side 72 of the bracket 48 to prevent the bracket 48 from moving along the length of the cage 36 in the direction of the arrow B. The stops 90 thus prevent the bracket 48 from moving in the direction of the arrow B off of the front end 38 of the cage 36. Optionally, and as can be seen in FIG. 6, the stops 90 extend through corresponding cutouts 128 of the EMI gasket 48.

In an exemplary embodiment, the four walls 124*a*, 124*b*, 124*c*, and 124*d* of the bracket 48 form an approximately rectangular shape to generally match the rectangular cross-sectional shape of the cage 36 and the EMI gasket 46. However, the bracket 48 may include any other shape, whether or not the shape of the bracket matches the shape of the cage 36 and/or the EMI gasket 46. Moreover, the bracket 48 may include any other number of walls 124 besides four, which optionally depends on the shape of the cage 36 and/or the EMI gasket 46.

Figure 7:
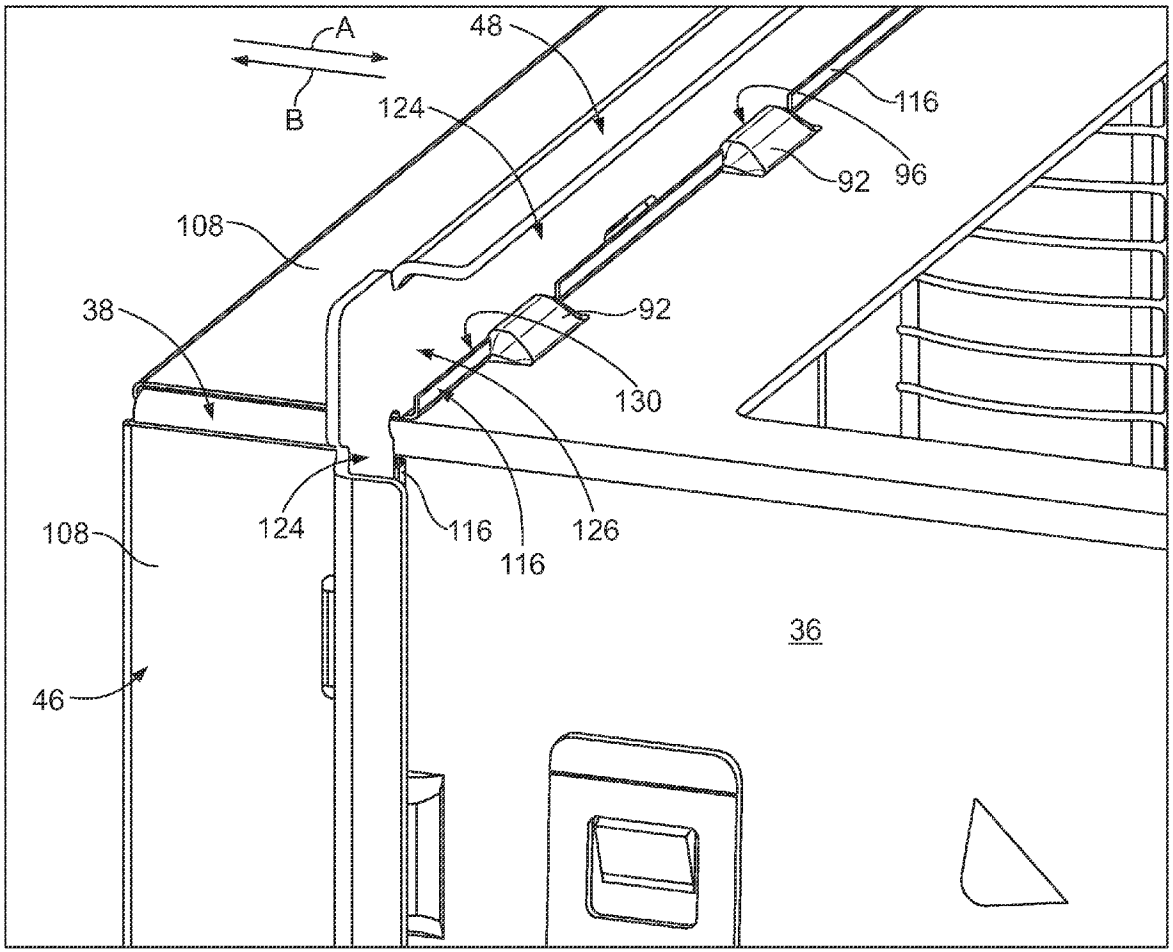
FIG. 7 is another perspective view illustrating the bracket mounted to the cage from a different angle than FIG. 6.

FIG. 7 is another perspective view illustrating the bracket 48 mounted to the cage 36 from a different angle than FIG. 6. The bracket 48 engages the EMI gasket 46 to hold the EMI gasket 46 on the front end 38 of the cage 36. More specifically, the bracket 48 engages the outer segments 108 of the EMI gasket 46 to hold the EMI gasket 46 on the cage 36. The bracket 48 engages the outer segments 108 at the flanges 116. The rear side 126 of the bracket 48 engages the front sides 130 of the flanges 116 to prevent the EMI gasket 46 from moving along the length of the cage 36 in the direction of the arrow B. The engagement between the flanges 116 and the bracket 48 thus prevents the EMI gasket 46 from moving in the direction of the arrow B off the front end 38 of the cage 36.

The stops 92 of the cage 36 engage the bracket 48 to hold the bracket 48 on the front end 38 of the cage 36. More specifically, the front side 96 of each stop 92 engages the rear side 126 of the bracket 48 to prevent the bracket 48 from moving along the length of the cage 36 in the direction of the arrow A. The stops 92 thus prevent the bracket 48 from moving in the direction of the arrow A toward the rear end 44 (FIGS. 1 and 2) of the cage 36. As should be apparent from a comparison of FIGS. 2 and 7, the walls 124 of the bracket 48 extend between the flanges 116 of the EMI gasket 46 and the panel 18 when the front end 38 of the cage 36 is mounted within the panel opening 20.

The embodiments described and/or illustrated herein may provide a bracket that both holds an EMI gasket on a cage and holds a compressive gasket in place on the cage. The embodiments described and/or illustrated herein may provide a cage and/or transceiver assembly that is more reliable, present fewer quality issues, and/or is cheaper to manufacture.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector assembly comprising:

a cage having a front end and an internal compartment, the front end being open to the internal compartment of the cage, the internal compartment being configured to receive a pluggable module therein through the front end, the cage comprising an exterior surface and an interior surface, the interior surface being opposite the exterior surface and defining a boundary of the internal compartment;

an electromagnetic interference (EMI) gasket mounted to the front end of the cage such that the EMI gasket is engaged with and electrically connected to the cage, the EMI gasket comprising electrically conductive springs that are configured to engage and electrically connect to the pluggable module when the pluggable module is received within the internal compartment of the cage, the EMI gasket comprising an outer segment that extends over at least a portion of the exterior surface at the front end of the cage, the EMI gasket comprising a flange that extends outward from the outer segment in a direction generally away from the interior surface of the cage; and a bracket mounted to the front end of the cage such that the bracket extends at least partially around the EMI gasket, the bracket having a wall that is engaged with the flange of the EMI gasket for holding the EMI gasket on the front end of the cage.

2. The assembly of claim 1, wherein the cage comprises a stop, the wall of the bracket being engaged with the stop for holding the bracket on the front end of the cage.

3. The assembly of claim 1, wherein the cage is configured to be mounted within an opening of a panel, the wall of the bracket being configured to extend between the flange of the EMI gasket and the panel when the cage is mounted within the opening of the panel.

4. The assembly of claim 1, wherein the EMI gasket comprises an inner segment that extends within the internal compartment over at least a portion of the interior surface at the front end of the cage, the inner segment comprising the springs, the outer segment of the EMI gasket extending from the inner segment, the bracket being engaged with the outer segment of the EMI gasket for holding the EMI gasket on the front end of the cage.

5. The assembly of claim 1, wherein the flange of the EMI gasket comprises a front side that faces generally toward the front end of the cage, the wall of the bracket comprising a rear side that faces generally away from the front end of the cage, the front side of the flange of the EMI gasket being engaged with the rear side of the wall of the bracket for holding the EMI gasket on the front end of the cage.

6. The assembly of claim 1, wherein the cage comprises a stop having a front side that faces generally toward the front end of the cage, the wall of the bracket comprising a rear side that faces generally away from the front end of the cage, the front side of the stop of the cage being engaged with the rear side of the wall of the bracket for holding the bracket on the front end of the cage.

7. The assembly of claim 1, wherein the springs extend within the internal compartment of the cage.

8. The assembly of claim 1, wherein the flange of the EMI gasket is defined by a bend in the outer segment of the EMI gasket.

9. The assembly of claim 1, wherein the EMI gasket comprises an inner segment that extends within the internal compartment over at least a portion of the interior surface at the front end of the cage, the inner segment comprising the springs, the outer segment of the EMI gasket extending a length from the inner segment to an end of the outer segment, the flange of the EMI gasket extending outward from the end of the outer segment.

10. The assembly of claim 1, wherein the wall of the bracket comprises a rear side that is engaged with the flange of the EMI gasket, the rear side of the wall extending continuously around a perimeter of the front end of the cage.

11. An electrical connector assembly comprising:

a cage having a front end and an internal compartment, the front end being open to the internal compartment of the cage, the internal compartment being configured to receive a pluggable module therein through the front end, the cage comprising an exterior surface and an interior surface, the interior surface being opposite the exterior surface and defining a boundary of the internal compartment, the cage comprising a stop that extends outward from the exterior surface in a direction generally away from the interior surface;

an electromagnetic interference (EMI) gasket comprising a base and electrically conductive springs that extend from the base, the base being mounted to the front end of the cage such that the base is engaged with and electrically connected to the cage and such that the springs extend within the internal compartment of the cage, the springs being configured to engage and electrically connect to the pluggable module when the pluggable module is received within the internal compartment of the cage, the EMI gasket comprising a flange; and a bracket mounted to the front end of the cage such that the bracket extends at least partially around the EMI gasket, the bracket having a wall that is engaged with the flange of the EMI gasket for holding the EMI gasket on the front end of the cage, the wall of the bracket being engaged with the stop of the cage for holding the bracket on the front end of the cage.

12. The assembly of claim 11, wherein the EMI gasket comprises an inner segment that extends within the internal compartment over at least a portion of the interior surface at the front end of the cage, the inner segment comprising the springs, the EMI gasket further comprising an outer segment that extends from the inner segment, the outer segment extending over at least a portion of the exterior surface at the front end of the cage.

13. The assembly of claim 11, wherein the cage comprises a wall, the EMI gasket comprising a pocket that is configured to receive the wall therein at the front end of the cage.

14. The assembly of claim 11, wherein the flange of the EMI gasket comprises a front side that faces generally toward the front end of the cage, the wall of the bracket comprising a rear side that faces generally away from the front end of the cage, the front side of the flange of the EMI gasket being engaged with the rear side of the wall of the bracket for holding the EMI gasket on the front end of the cage.

15. The assembly of claim 11, wherein the stop has a front side that faces generally toward the front end of the cage, the wall of the bracket comprising a rear side that faces generally away from the front end of the cage, the front side of the stop of the cage being engaged with the rear side of the wall of the bracket for holding the bracket on the front end of the cage.

16. The assembly of claim 11, further comprising a compressive gasket, wherein the cage is configured to be mounted within an opening of a panel, the compressive gasket being sandwiched between the panel and the wall of the bracket when the cage is mounted within the opening of the panel.

17. The assembly of claim 11, wherein the flange of the EMI gasket comprises an opening that extends through the flange, the stop being received into the opening such that the stop is engaged with the bracket through the flange.

18. A transceiver assembly comprising:

a pluggable module; and a receptacle assembly comprising a cage and a receptacle connector received within the cage, the cage extending a length from a front end to a rear end, the cage having an internal compartment, the front end being open to the internal compartment of the cage, the cage comprising a stop, the receptacle connector being positioned within the internal compartment of the cage at a rear end of the cage, the internal compartment being configured to receive the pluggable module therein in electrical connection with the receptacle connector, the receptacle assembly further comprising an electromagnetic interference (EMI) gasket and a bracket, the EMI gasket is mounted to the front end of the cage such that the EMI gasket is engaged with and electrically connected to the cage, the EMI gasket comprising electrically conductive springs that are configured to engage and electrically connect to the pluggable module when the pluggable module is received within the internal compartment of the cage, the EMI gasket comprising a flange having an opening that extends through the flange along a path that is not perpendicular to the length of the cage, the bracket being mounted to the front end of the cage such that the bracket extends at least partially around the EMI gasket, the bracket comprising a wall that is engaged with the EMI gasket for holding the EMI gasket on the front end of the cage, the stop of the cage being received into the opening of the flange such that the stop is engaged with the bracket through the flange for holding the bracket on the front end of the cage.

19. The assembly of claim 18, wherein the flange of the EMI gasket comprises a front side that faces generally toward the front end of the cage, the wall of the bracket comprising a rear side that faces generally away from the front end of the cage, the front side of the flange of the EMI gasket being engaged with the rear side of the wall of the bracket for holding the EMI gasket on the front end of the cage.

20. The assembly of claim 18, wherein the cage comprises an exterior surface and an interior surface, the interior surface being opposite the exterior surface and defining a boundary of the internal compartment, the EMI gasket comprising an inner segment that extends within the internal compartment over at least a portion of the interior surface at the front end of the cage, the inner segment comprising the springs, the EMI gasket further comprising an outer segment that extends from the inner segment, the outer segment extending over at least a portion of the exterior surface at the front end of the cage, the bracket being engaged with the outer segment of the EMI gasket for holding the EMI gasket on the front end of the cage.

* * * * *